US010928778B2

(12) United States Patent
Kraehenbuehl et al.

(10) Patent No.: US 10,928,778 B2
(45) Date of Patent: Feb. 23, 2021

(54) TIMEPIECE PROVIDED WITH A DIAL AND ASSOCIATED FASTENING METHOD

(71) Applicant: ETA SA Manufacture Horlogere Suisse, Grenchen (CH)

(72) Inventors: David Benjamin Kraehenbuehl, Bettlach (CH); Jonathan Collaud, Givisiez (CH); Marco Bettelini, Preles (CH); Andre Nussbaum, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 25 days.

(21) Appl. No.: 15/127,322

(22) PCT Filed: Feb. 26, 2015

(86) PCT No.: PCT/EP2015/054062
§ 371 (c)(1),
(2) Date: Sep. 19, 2016

(87) PCT Pub. No.: WO2015/144382
PCT Pub. Date: Oct. 1, 2015

(65) Prior Publication Data

US 2018/0173163 A1 Jun. 21, 2018

(30) Foreign Application Priority Data

Mar. 25, 2014 (EP) ..... 14161593

(51) Int. Cl.
*G04B 19/14* (2006.01)
*G04B 19/04* (2006.01)
(Continued)

(52) U.S. Cl.
CPC ..... *G04B 19/14* (2013.01); *G04B 19/042* (2013.01); *G04B 19/065* (2013.01); *G04B 19/12* (2013.01)

(58) Field of Classification Search
CPC ..... G04B 19/065; G04B 19/12; G04B 19/14
See application file for complete search history.

(56) References Cited

U.S. PATENT DOCUMENTS 1,065,952 A * 7/1913 Marsh ..... G04B 19/14 368/236
1,441,279 A * 1/1923 Hammarlund ..... G04B 37/0481 248/114
(Continued)

FOREIGN PATENT DOCUMENTS

CH 706 764 A2 1/2014
GB 2 079 497 A 1/1982
(Continued)

OTHER PUBLICATIONS

Delacretaz, Charles-Henri, English Translation of JP 07318665, originially published Dec. 8, 1995, retrieved from Espacenet on Apr. 30, 2018, full document.*
(Continued)

*Primary Examiner* — Daniel P Wicklund
(74) *Attorney, Agent, or Firm* — Oblon, McClelland, Maier & Neustadt, L.L.P.

(57) ABSTRACT

A timepiece including a case that houses a main plate of a movement surmounted by a dial, and a support including fastening studs arranged on an upper face of the main plate for mounting the dial. The dial and the support include an angular locking mechanism for locking an angular position of the dial on the support, and the dial is assembled to the main plate by at least one flexible fastening element integral with the dial and arranged in the plane of the dial.

19 Claims, 5 Drawing Sheets

(51) Int. Cl.
*G04B 19/06* (2006.01)
*G04B 19/12* (2006.01)

(56) References Cited

U.S. PATENT DOCUMENTS

| | | | | | |
|---|---|---|---|---|---|
| 5,043,957 | A * | 8/1991 | Kaelin | G04B 37/05 | 368/300 |
| 5,703,837 | A * | 12/1997 | Umemoto | G04B 19/12 | 368/227 |
| 6,456,569 | B1 * | 9/2002 | Stauffer | G04B 19/06 | 368/236 |
| 2012/0120779 | A1 * | 5/2012 | Altenhoven | G04B 3/048 | 368/300 |
| 2012/0257481 | A1 * | 10/2012 | Hiranuma | G04G 17/02 | 368/205 |
| 2014/0016446 | A1 * | 1/2014 | Correa | G04B 19/14 | 368/232 |
| 2014/0029393 | A1 * | 1/2014 | Leoni | G04B 19/14 | 368/236 |

FOREIGN PATENT DOCUMENTS

| | | | | |
|---|---|---|---|---|
| JP | 07318665 | A * | 12/1995 | G04B 19/14 |
| WO | WO-2015071719 | A2 * | 5/2015 | G04B 37/033 |

OTHER PUBLICATIONS

International Search Report dated Apr. 17, 2015 in PCT/EP2015/054062 Filed Feb. 26, 2015.

* cited by examiner

TIMEPIECE PROVIDED WITH A DIAL AND ASSOCIATED FASTENING METHOD

The present invention concerns a dial provided with particular fastening elements and a method for fastening such a dial in a watch case.

BACKGROUND OF THE INVENTION

In the field of horology, there are various methods for fastening dials to the watch movement. The most conventional method used in high horology consists in using feet, which are assembled at the periphery of the movement, for example by soldering or bonding, and then pressed into orifices provided for this purpose in the main plate of the movement. The drawback of such a method is that it requires very high machining precision for placing the dial on the movement and angularly positioning it; further the pressing-in operation is cumbersome and consequently considerably slows the speed of assembly.

For low end watches, for example for quartz movements with a plastic main plate, the dial is usually temporarily fixed to the movement by means of a setting ring before the assembly thereby formed is fitted inside the case; permanent fastening is then ensured by the subsequent assembly of other parts, such as, for example, an annular part partially covering the periphery of the dial. During this intermediate assembly operation, the setting ring is plastically deformed so that it clamps the periphery of the dial and thus holds it against the upper face of the main plate. One drawback of this fastening method is that it is unsuitable for dials made of a relatively flexible material, which may then bow or bend. Further, to prevent the dial inadvertently slipping or being ejected during subsequent assembly operations, it is often necessary to add a dot of adhesive to ensure that this temporary fastening holds.

Adding a dot of adhesive is, however, disadvantageous in aesthetic terms, since the dot of adhesive is sometimes visible: it may also result in harmful gas emissions during drying. Moreover, this adhesive bonding operation also requires the use of an additional station on the assembly line, or possibly even an additional machine, which is not only expensive but also considerably slows down the rate of production.

There is also known from CH Patent 706764 another device for fastening a dial to a main plate using, firstly, centring pins to lock the translational and rotational degrees of freedom in the plane of the dial, and secondly, retaining clips associated with elastic return means to remove the last, vertical degree of freedom on the axis of rotation of the hands, i.e. by keeping the dial pressed against the main plate. The drawback of this assembly device is that the elastic return means, at whose ends the clips are arranged, extend vertically along the axis of the hands, which tends to considerably increase the thickness of the movement; further, the clips require relatively precise machining to ensure an adequate retaining force at all the fastening points, which is costly; finally, due to plastic creep, the dial is not guaranteed to remain pressed against the main plate over time.

There is also known, from GB Patent 2079497, another dial assembly structure employing securing pins and at least one flexible portion. The pins are inserted in orifices in the main plate and the dial, and the flexible portion can be deformed during assembly, which makes it easier to take up any play and thus to simplify the assembly process which does not require verification of multiple simultaneous alignments. However, in order to keep the dial pressed on the main plate, a specific profile shape of the pins is required, and any subsequent disassembly thus requires disassembly of the pins. Further, the use of clamps is necessary to deform the flexible portion, which considerably reduces production rates.

Solutions are therefore required for mounting a dial in a case which are free of these known limitations.

SUMMARY OF THE INVENTION

To this end, the present invention concerns a timepiece comprising a case which houses a main plate of a movement surmounted by a dial, a support provided with fastening studs being arranged on an upper face of said main plate for mounting the dial, characterized in that the dial and the support comprise angular locking means for locking the angular position of the dial on the support, and in that the dial is assembled to the main plate by means of at least one flexible fastening element integral with the dial and arranged in the plane of the dial.

The present invention also concerns an assembly method for such a timepiece comprising a case, a main plate of a movement and a dial, characterized in that it includes a first step of temporarily assembling the dial on a support disposed on an upper face of the main plate by means of at least one flexible fastening element integral with the dial and arranged in the plane of the dial, a second step of inserting the main plate-dial assembly thereby formed in the case, followed by a third permanent assembly step of axially locking the dial pressed against the main plate support by means of an axial locking element.

Finally, the present invention also concerns a dial and a main plate for the claimed timepiece each taken separately according to a preferred embodiment, namely:

- a dial characterized in that it includes an element for angularly locking the position of said dial on said support and at least one flexible fastening tab extending in the plane of the dial, and
- a movement main plate provided with a support on the upper face thereof, characterized in that it contains at least one fastening stud of constant section oriented in a direction perpendicular to the plane in which the support extends.

One advantage of the solution proposed by the present invention is that it allows the dial to be mounted to the main plate more easily and quickly, without requiring an additional station in an assembly line to axially lock the dial on the main plate, i.e. to ensure the dial is kept pressed on the support.

Another advantage of the proposed solution is that it avoids any undue deformation of the dial during assembly, particularly for plastic dials, and does not require any particular tools.

BRIEF DESCRIPTION OF THE DRAWINGS

Other features and advantages of the invention will become clear from the detailed description and drawings, given by way of non-limiting example, in which.

DETAILED DESCRIPTION

In the following description, there is first described a known prior art solution for fastening dials using a setting ring, with reference to FIGS. 1A and 1B, in order then to better explain the differences and advantages of the solution proposed by the present invention compared to that assembly method.

Figure 1A:
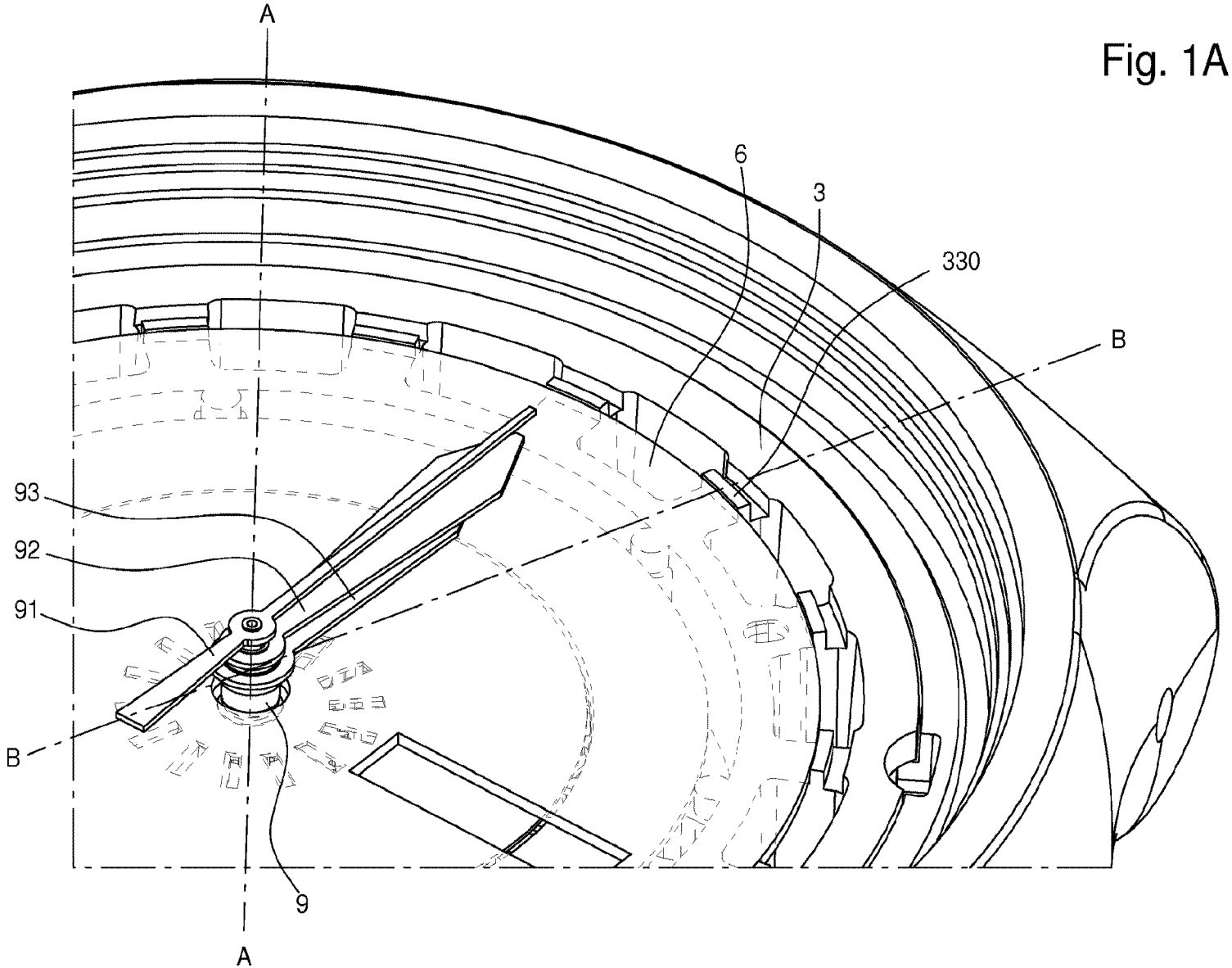
FIGS. 1A and 1B respectively show top and cross-sectional views of a dial assembled by a prior art method with a setting ring; the ring is not yet deformed in FIG. 1A and deformed in FIG. 1B.

FIG. 1A shows a movement main plate 3, on the upper face of which is placed a dial 6, the centre of which is traversed by a pipe 9 of the seconds hand 91, of the minute hand 92, and of the hour hand 93, which extends along an axis A-A perpendicular to the plane of dial 6. At the periphery of the dial are arranged a series of parts disposed around a ring extending around the periphery of the disc of dial 6, commonly called the setting ring 330 of dial 6.

Figure 1B:
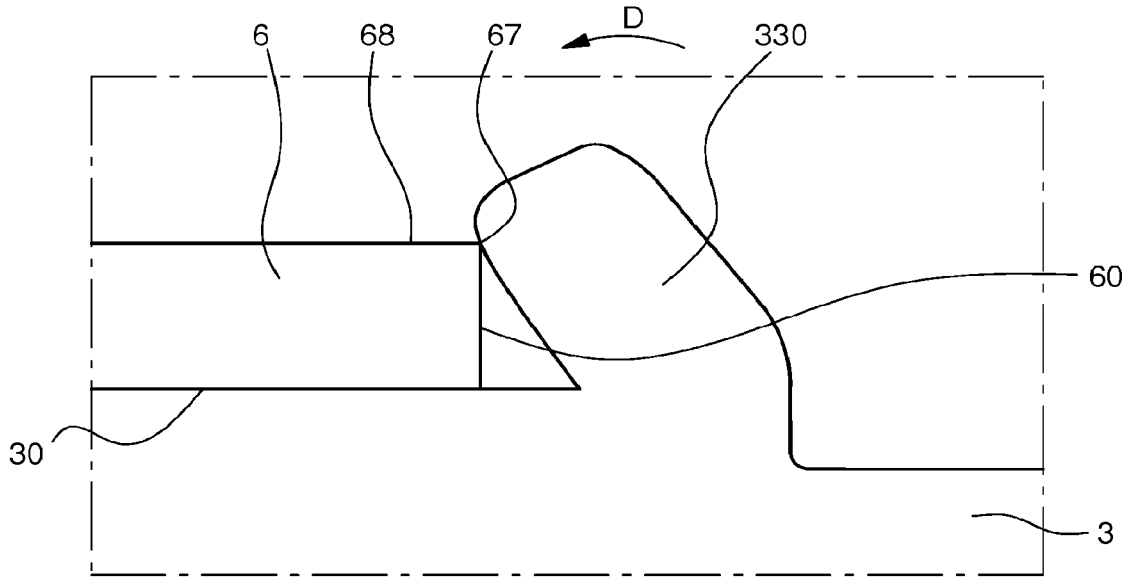

FIG. 1B, which shows a cross-sectional view along axis B-B visible in FIG. 1A through setting ring 330, explains how dial 6 is kept pressed against main plate 3. Once dial 6 has been affixed to its support 30, arranged on the upper face of the main plate, setting ring 330 is deformed inwards due to the application of a deformation force D, illustrated by the arrow pointing towards the centre of dial 6, with the aid, for example, of clamps, such that it abuts against the edge 60 of dial 6 on rim 67. In FIG. 1B, its end slightly covers upper face 68 of the dial. Thus, although dial 6 is held against its support 30, the simultaneous folding of setting ring 330 on the two diametrically opposite edges 60 of dial 6 also tends to deform the dial, since the compression of rims 67 exerts a torsion couple which may result in a slight bowing of dial 6. Depending on the hardness of the material used for dial 6, the centre of the dial lifts away from its support 30 to a greater or lesser extent.

Figure 2:
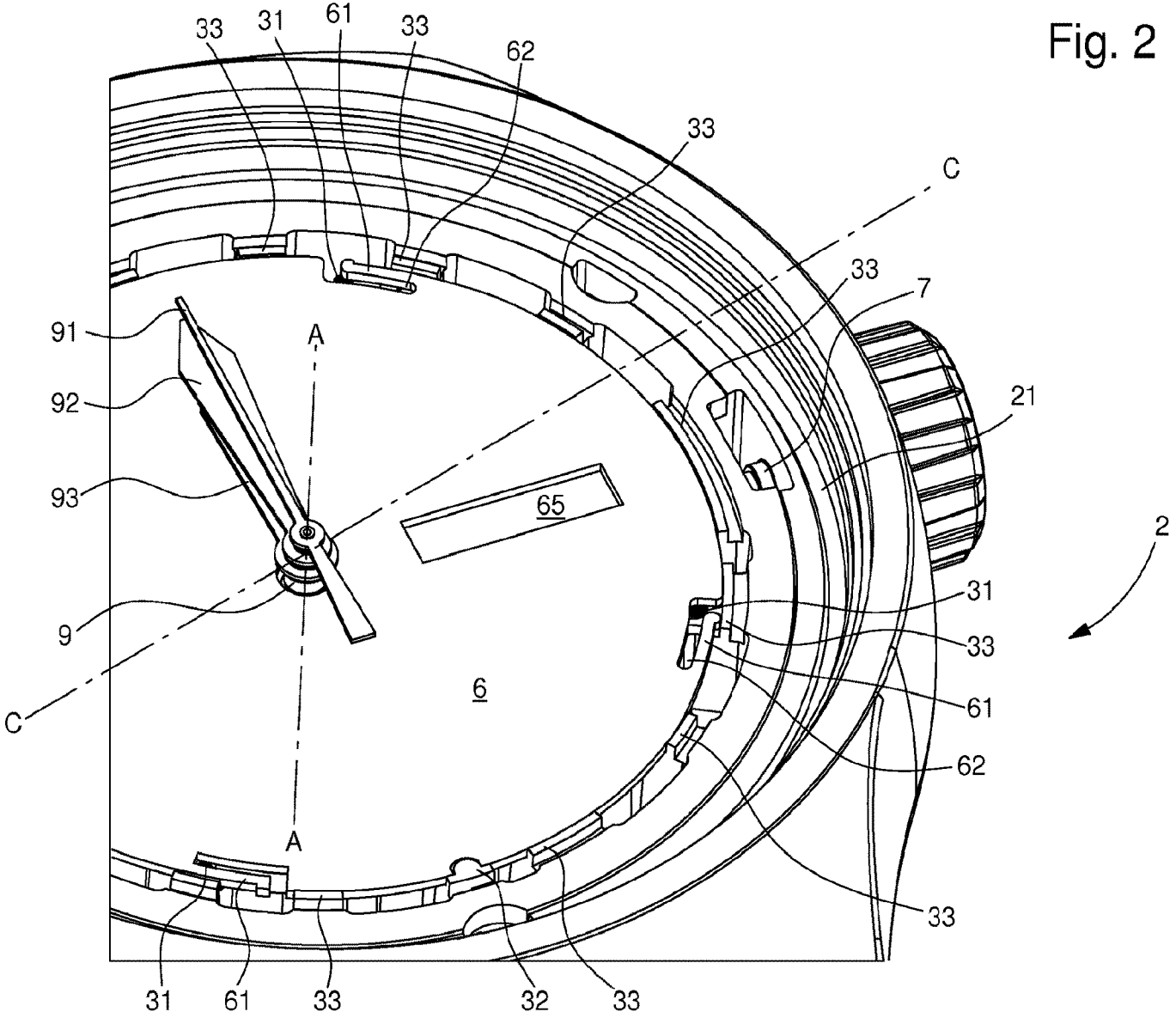
FIG. 2 shows a top view of a dial assembled according to a preferred method of the invention.

To overcome this drawback, the proposed solution no longer uses setting ring 330, and instead proposes flexible fastening elements which no longer exert any torsion force on the dial. To this end, according to the preferred embodiment illustrated by FIG. 2, showing a dial 6—main plate 3 assembly inserted in the case 2 of a wristwatch provided with a control stem 7, dial 6 is provided with integral flexible fastening elements, preferably in the form of tabs 61 made of the same material as dial 6, in order to limit the machining costs of these fastening elements. Thus, depending on requirements, these tabs 61 could be made of metal or plastic. To achieve fastening to main plate 3, these tabs 61, which are also arranged in the plane of dial 6 to facilitate machining and to limit the vertical space required inside case 2, cooperate with fixed elements of the main plate, formed here by studs 31 extending vertically along axis A-A of pipe 9 of the hands (i.e. seconds hand 91, minute hand 92 and hour hand 93). These fastening studs 31 are also preferably cylindrical, for example to facilitate moulding and to maximise friction forces with the tabs, and also of constant section, i.e. not shaped, in order to allow for easy insertion of the dial on fastening studs 31 from above, along this vertical axis A-A.

Dial 6, whose date display aperture 65 can also be seen, is thus preferably affixed vertically on a support disposed on the upper face of main plate 3 in the direction of axis A-A of the pipe until it abuts on a bearing surface of support 30 (not shown in FIG. 2 but visible in the FIG. 3 cross-section detailed below). The radial positioning of dial 6 on the support, i.e. with respect to the centre of axis A-A of pipe 9 of the hands, is facilitated by peripheral abutment elements 33 extending around a ring on the periphery of dial 6; the latter can also make up for machining tolerances between pipe 9 of the hands of the movement and the central orifice 65 of dial 6 where the pipe is inserted.

When dial 6 is set in place on support 30 of main plate 3, each of fastening tabs 61, none of which projects radially here from the periphery of dial 6, engages around a corresponding fastening stud 31 arranged on support 30 of main plate 3, automatically deforming slightly outwards, without requiring external intervention, such as, for example, clamps etc. Fastening stud 31 then slides into the groove 62 arranged between the dial body and tab 61, and remains clamped by tab 61 which exerts a return force towards the interior of dial 6. The friction forces exerted between stud 31, the body of dial 6 and tab 61 thus jointly prevent any rotational motion of the dial with respect to main plate 3 and any vertical motion along axis A-A of pipe 9. In this manner, tabs 61 are not only arranged in the plane of dial 6 at rest, but they also remain in the same plane as they deform and clamp studs 31, which considerably facilitates the assembly operation.

For more efficient angular locking of the position of dial 6 with respect to main plate 3, i.e. to permanently remove any rotational degree of freedom in this plane, a mistake proofing system is provided between these two parts; an inner radial protuberance 32 is therefore provided on the main plate for insertion in a notch 64 arranged at the periphery of dial 6. According to a variant, angular locking could be achieved by means of a bayonet assembly device, by inserting fastening stud 31 so that it abuts on the bottom 620 of groove 62. In such case, angular locking would be ensured exclusively by means of friction forces and would require, in the event of use of a plurality of fastening tabs 61—and thus of associated grooves 62—and of fastening studs 31, more precise machining to ensure that each of the angular positions coincide with the end stop position of a fastening stud 31 against the bottom 62 of a corresponding groove.

One advantage of the proposed solution for fastening dial 6 to main plate 3 is that, not only is body of dial 6 no longer deformed, but there is no longer a requirement for an assembly station to remove, even temporarily, any degrees of freedom of dial 6 with respect to main plate 3. Indeed, owing to the fact that the dial is inserted on main plate 3 along axis AA, in order to be affixed on support 30, and that tabs 61 are arranged in the plane of dial 6, namely perpendicularly to axis A-A, the assembly of dial 6 on support 30 automatically causes the deformation of flexible tabs 61 around fastening studs 31, oriented along the same axis A-A, i.e. in a direction perpendicular to dial 6 and to the plane in which the bearing surface of support 30 extends. Thus, these tabs 61 do not require specific handling by a dedicated machine or by an external operator in order to perform their locking function, which results in additional productivity savings.

Nonetheless, given that the degree of freedom along axis AA is removed exclusively by friction forces, this solution for mounting dial 6 on main plate 3 will subsequently preferably be supplemented by a step of locking the dial pressed against support 30 of the main plate, to permanently remove this axial degree of freedom.

FIG. 2 shows dial 6 assembled to main plate 3 according to a preferred embodiment using flexible tabs 61 arranged in the plane of dial 6 and extending in a tangential direction at the periphery thereof, after assembly to each other, and insertion in case 2, but prior to the assembly of crystal 5.

After this first step of assembly to each other, which will be termed temporary since not all of the degrees of freedom have been permanently removed, and this second step of insertion into the case, according to a preferred assembly embodiment, a third permanent assembly step will be performed by axially locking dial 6 bearing against support 30 by means of an axial locking element preferably formed precisely by the timepiece crystal 5, which closes the case by bearing against a shoulder 21 of the case middle.

Figure 3:
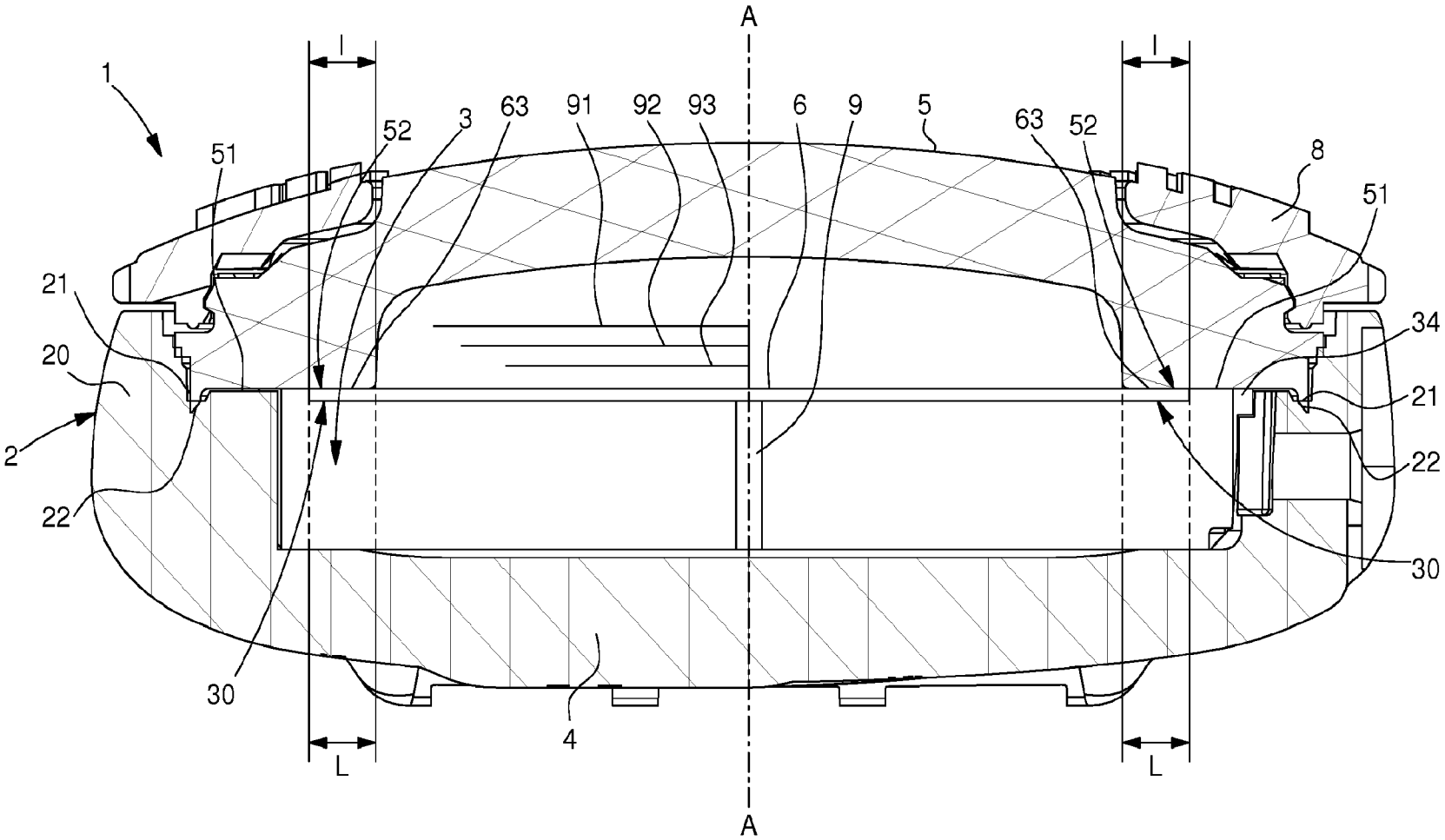
FIG. 3 shows a timepiece in a completely assembled position, after assembly of the crystal.

FIG. 3 shows a cross-section of a timepiece 1 in a completely assembled position, showing the axial locking, in the vertical degree of freedom, of dial 6 along axis A-A of pipe 9 of the hands with respect to main plate 3. According to a preferred embodiment, the timepiece was first assembled by mounting dial 6 on support 30, arranged on the upper surface of the main plate, support 30 taking the form here of an annular bearing surface of a first width "L". Thus, only an annular peripheral edge 63 of the dial, of a corresponding width, is bearing on support 30. Once dial 6 is assembled to main plate 3, the hands (namely hour hand 93, minute hand 92 and seconds hand 91) can be mounted on pipe 9 above dial 6. The main plate 3-dial 6 assembly is then inserted in case 2, which is formed here of a one-piece case middle-back cover, the back of case 4 being formed in a single piece with case middle 20, for example by pressing the thread of movement 34 against an inner shoulder of case middle 20. The crystal 5-bezel 8 assembly, which is preferably pre-assembled, then need to be mounted to case middle 20.

As illustrated in the preceding FIG. 2, case middle 20 preferably includes a shoulder 21 for crystal 5, against which the heel 51 of the crystal bears. Crystal 5 is then preferably heat welded to case middle 20 in heat welding areas 22, represented by small beaks on the outer periphery of heel 51. During this step of heat welding crystal 5 to case middle 20 of case 2, one portion 52 of heel 51 of crystal 5 bears against the upper surface of the peripheral edge 63 of dial 6, which is thus sandwiched between portion 52 of heel 51 and the annular bearing surface of support 30, thus permanently preventing any motion of dial 6 along axis A-A. This embodiment is therefore particularly advantageous since it does not require a dedicated operation for axial locking of dial 6, which is achieved jointly with the mounting of crystal 5 to case middle 20 of case 2. Further, it will be noted that, according to this preferred embodiment, portion 52 of heel 51 of crystal 5 has a second width "I" equal to first width "L" of the angular bearing surface of support 30, such that torsion stresses are optimised for dial 6 in the event of deformation of case 2 or of crystal 5 under heavy pressure stresses, notably during deep underwater immersion, for example a depth of more than 100 m, particularly if case 2 is made of plastic, which is more plastically deformable than metal.

Figure 4A:
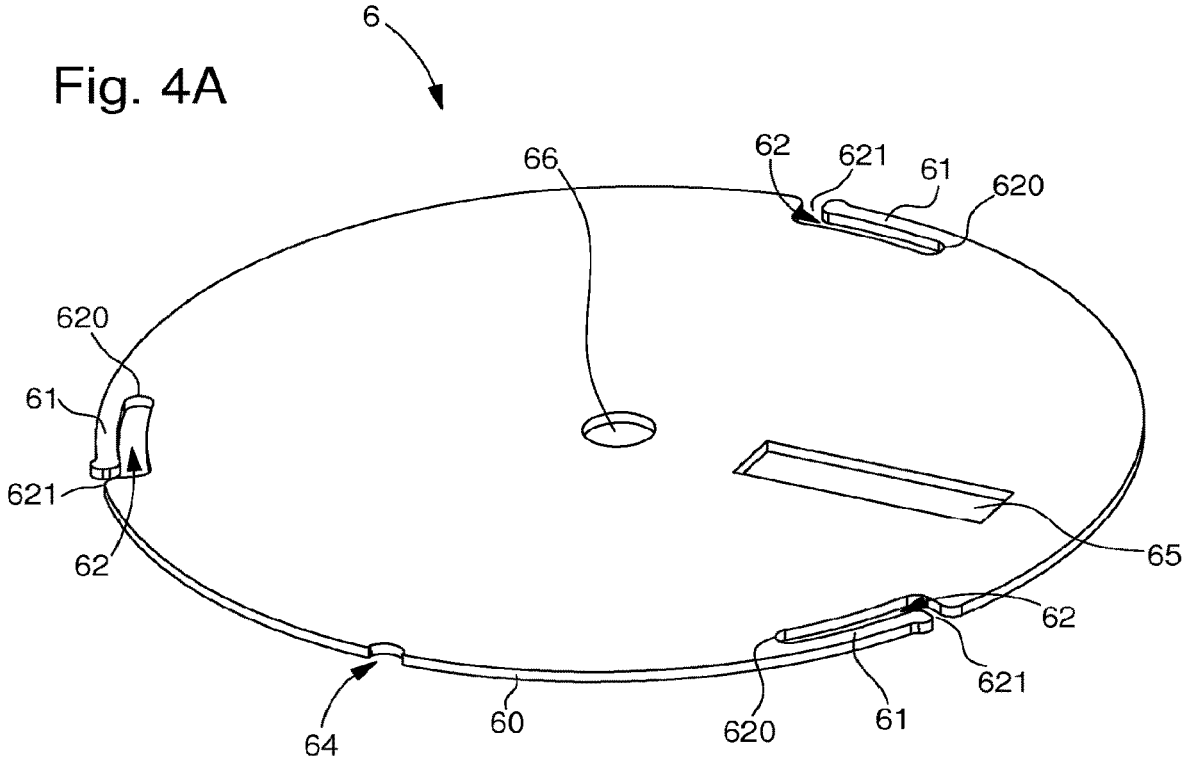
FIGS. 4A and 4B show two preferred embodiments of dials employed for implementing the assembly solution of the present invention.

FIG. 4A shows a dial 6, preferably made of plastic and used in the preferred fastening embodiment illustrated in FIG. 2, comprising a central opening 66 for passage of the hand pipe and conventionally an aperture 65. According to this preferred embodiment, the flexible fastening elements are integral tabs 61 arranged at the periphery of dial 6, without however projecting from the edge thereof, in immediate proximity to which are arranged grooves 62 for the insertion of fastening studs 31 integral with main plate 3. Each groove 62 has a bottom 620 which acts as a stop surface, opening onto an opening 621 which allows for insertion of fastening studs 31 underneath tab 61, i.e. between the body of dial 6 and tab 61. Although according to this preferred embodiment, a notch 64 is provided at the dial periphery to angularly lock dial 6, it is also possible to affix dial 6 on its support 30 and then lock it in rotation by turning the dial in the counterclockwise direction S until studs 31 are stopped against the bottoms 620 of groove 62. The number of tabs, equal to 3 here, makes it possible to increase the friction forces between fastening studs 31 and tabs 61, and thus to maximise the locking force without requiring any great height for dial 6, represented by the thickness of edge 60.

Figure 4B:
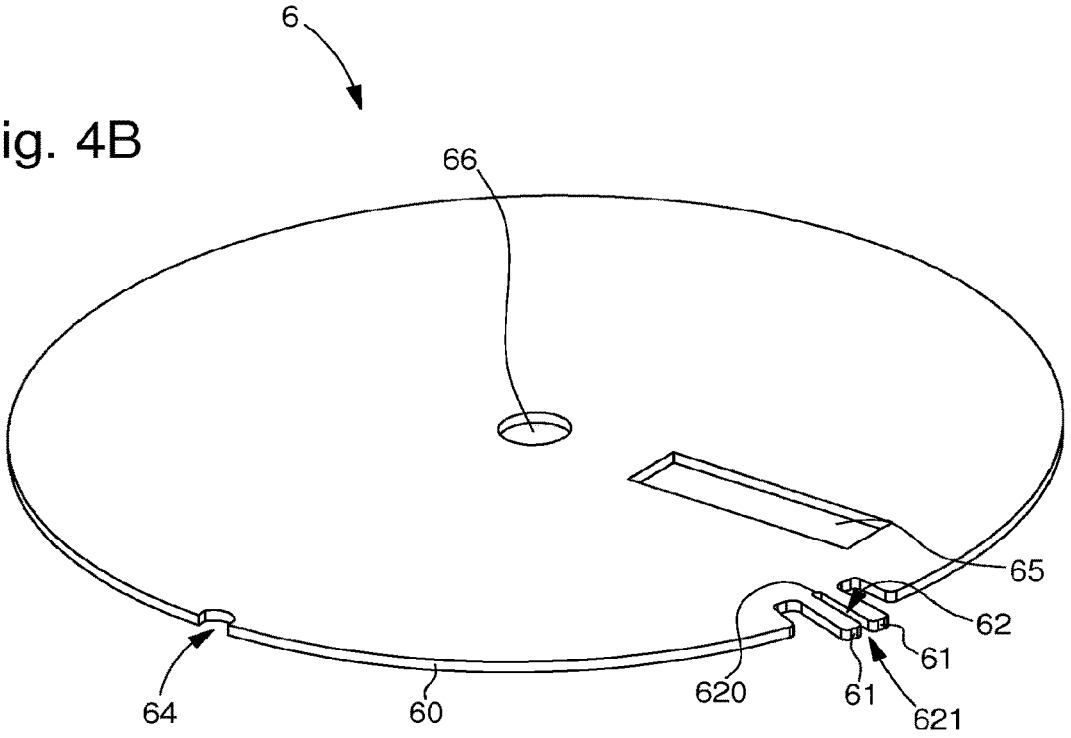

However, according to an alternative embodiment, is possible to use only two flexible fastening tabs 61, arranged in a radial direction rather than a tangential direction to the periphery of dial 6. Such an embodiment of the dial is illustrated in FIG. 4B, which shows a dial 6 comprising the same basic elements as dial 6 of FIG. 4A, namely a central opening 66 for the passage of pipe 9, and an aperture 65 and a notch 64 for angularly locking the position of dial 6. Tabs 61 take the form of two radial lugs, separated by a slot corresponding to groove 62 of the FIG. 4A embodiment. This slot thus also ends in a bottom 620 forming a radial stop and also opens onto an opening 621 for insertion of fastening stud 31 between the two tabs 61, whose deformation exerts a return force that clamps the stud and ensures the friction hold. The advantage of this solution is that it improves the angular locking of dial 6 owing to the presence of elements whose radial orientation structurally prevents any rotational motion, and thus offers a type of double security with respect to the mistake proofing system formed by notch 64 in dial 6 and inner radial protuberance 32 on main plate 3; however, the friction surfaces are more limited due to the restricted number of tabs 61, for the same thickness of edge 60. The deformation of each tab 61 occurs however, as in the other preferred embodiment described above with reference to FIG. 4A, exclusively in the plane of the dial, which makes the assembly operation particularly easy and intuitive to perform.

Those skilled in the art will understand that other fastening arrangements of "male" and "female" type fastening elements are also possible, flexible tabs 61 here allowing "female" type fastening elements to be formed, i.e. the grooves 62 in which the "male" fastening studs 31 are inserted, but these fastening elements could also be switched between the main plate 3 and dial 6. It will be understood also that the fastening solution also applies to dials 6 provided with LCD digital display modules and not exclusively to analogue displays for movements with hands.

The invention claimed is:

1. A timepiece comprising:

a case that houses a main plate of a movement surmounted by a dial; and a support including a fastening stud arranged on an upper face of the main plate for mounting the dial;

wherein the dial and the support form angular locking means for locking an angular position of the dial on the support, wherein the dial includes a flexible tab which is integral with the dial and is arranged in the plane of the dial, the flexible tab forming a groove to accommodate the fastening stud, and wherein the dial is assembled to the main plate by engagement of the fastening stud and the flexible tab, the dial being locked to the support when the fastening stud reaches a bottom of the groove, the bottom acting as a stop surface against the fastening stud, the dial being rotated with respect to the main plate so that the fastening stud reaches the bottom of the groove.

2. The timepiece according to claim 1, wherein the fastening stud is cylindrical.

3. The timepiece according to claim 1, wherein the support for the dial includes an annular bearing surface and peripheral stop members for radial positioning of the dial resting on the support.

4. The timepiece according to claim 1, further comprising additional axial locking means for keeping the dial pressed against the support.

5. The timepiece according to claim 4, wherein the additional axial locking means includes a heel of a watch crystal.

6. The timepiece according to claim 1, wherein the dial and the main plate comprise a bayonet assembly device.

7. An assembly method for the timepiece according to claim 1, comprising the case, the main plate of the movement, and the dial, wherein the method comprises:

mounting temporarily the dial on the support disposed on the upper face of the main plate by the flexible tab integral with the dial and arranged in the plane of the dial;

inserting an assembly of the main plate and the dial formed in the case; and assembling permanently by axially locking the dial pressed against the support of the main plate by an axial locking element.

8. The assembly method for the timepiece according to claim 7, wherein the assembling through axial locking is achieved jointly with a mounting of a crystal to the case, at least one portion of a heel of the crystal bearing against an annular peripheral portion of the dial.

9. The timepiece according to claim 1, wherein the angular locking means includes on the dial an element for angularly locking the position of the dial on the support and at least one flexible fastening tab extending in the plane of the dial.

10. The timepiece according to claim 9, wherein the element for angularly locking the position of the dial on the support includes a peripheral notch.

11. The timepiece according to claim 1, the main plate comprising the support on the upper face thereof, and the fastening stud being of a constant section oriented in a direction perpendicular to the plane in which the dial extends.

12. A timepiece comprising:

a case that houses a main plate of a movement surmounted by a dial having a central axis that is perpendicular to a plane of the dial and a circular outer edge; and a support including a fastening stud arranged on an upper face of the main plate for mounting the dial;

wherein an angular position of the dial is configured to be locked on the support, wherein one of the dial and the support includes a protuberance and the other of the dial and the support includes a notch to accommodate the protuberance, wherein the dial includes at least one flexible tab which is integral with the dial and is arranged in the plane of the dial, the at least one flexible tab extending radially further from the central axis than the circular outer edge and forming a groove to accommodate the fastening stud, wherein the dial is assembled to the main plate by engagement of the fastening stud and the at least one flexible tab, wherein the at least one flexible tab includes two radially extending elongate flexible tabs between which is formed the groove, a width of the groove being smaller than a width of each of the two flexible tabs, wherein lateral grooves are positioned immediately outside of the two flexible tabs to allow the tabs to flex radially, and the fastening stud is to be frictionally held by the flexible tabs, and wherein the lateral grooves positioned immediately outside of the two flexible tabs are wider than the groove formed between the two flexible tabs.

13. The timepiece according to claim 12, wherein the fastening stud is cylindrical.

14. The timepiece according to claim 12, wherein the support for the dial includes an annular bearing surface and peripheral stop members for radial positioning of the dial resting on the support.

15. The timepiece according to claim 12, wherein the dial and the main plate comprise a bayonet assembly device.

16. An assembly method for the timepiece according to claim 12, comprising the case, the main plate of the movement, and the dial, wherein the method comprises:

mounting temporarily the dial on the support disposed on the upper face of the main plate by the flexible tab integral with the dial and arranged in the plane of the dial;

inserting an assembly of the main plate and the dial formed in the case; and assembling permanently by axially locking the dial pressed against the support of the main plate.

17. The assembly method for the timepiece according to claim 16, wherein the assembling through axial locking is achieved jointly with a mounting of a crystal to the case, at least one portion of a heel of the crystal bearing against an annular peripheral portion of the dial.

18. The timepiece according to claim 12, the main plate comprising the support on the upper face thereof, and the fastening stud being of a constant section oriented in a direction perpendicular to the plane in which the dial extends.

19. The main plate of the timepiece movement according to claim 12, wherein the notch is semi-spherical.

* * * * *